US007938730B2

(12) United States Patent
Richardson et al.

(10) Patent No.: US 7,938,730 B2
(45) Date of Patent: May 10, 2011

(54) ROTATING SWING DEVICE

(76) Inventors: Raymond B. Richardson, Kennewick, WA (US); Shane A. Bales, Benton City, WA (US)

( * ) Notice: Subject to any disclaimer, the term of this patent is extended or adjusted under 35 U.S.C. 154(b) by 162 days.

(21) Appl. No.: 12/475,276

(22) Filed: May 29, 2009

(65) Prior Publication Data

US 2010/0304875 A1 Dec. 2, 2010

(51) Int. Cl.
*A63H 13/20* (2006.01)
*A63G 1/36* (2006.01)

(52) U.S. Cl. ..... 472/7; 472/39; 446/325

(58) Field of Classification Search ..... 472/7–12, 472/28–34, 36–39, 45–47, 131; 446/325, 446/366; 74/49, 50, 721
See application file for complete search history.

(56) References Cited

U.S. PATENT DOCUMENTS

| | | | | | |
|---|---|---|---|---|---|
| 2,163,360 | A * | 6/1939 | Bisch | 472/33 |
| 2,282,763 | A * | 5/1942 | Kennedy | 472/39 |
| 2,433,807 | A * | 12/1947 | Bartlett | 472/33 |
| 2,765,168 | A * | 10/1956 | Taylor | 472/33 |
| 2,983,509 | A * | 5/1961 | Haug | 472/39 |
| 4,012,038 | A * | 3/1977 | Brotz | 273/456 |
| 4,428,576 | A * | 1/1984 | Fisher, Jr. | 472/22 |
| 4,576,373 | A * | 3/1986 | Spieldiener et al. | 472/33 |
| 5,078,386 | A * | 1/1992 | Hou et al. | 472/7 |
| 5,203,743 | A * | 4/1993 | Hou et al. | 472/7 |
| 5,480,355 | A * | 1/1996 | Miller | 472/29 |
| 5,810,641 | A * | 9/1998 | Lo | 446/325 |
| 6,319,135 | B1 * | 11/2001 | Monson | 472/32 |

* cited by examiner

*Primary Examiner* — Kien T Nguyen

(57) ABSTRACT

The Rotating Device (1) comprises a rotating shaft (1000) being bearing interrelated to a nipple/coupling frame. The rotating shaft (1000) supports swing arms right and left from which are suspended swing seats. The nipple/coupling frame extends into and is supported by a generally concrete foundation.

7 Claims, 2 Drawing Sheets

ROTATING SWING DEVICE

FIELD OF THE INVENTION

This invention relates to an apparatus for a rotating device including rotation for children's swings.

BACKGROUND OF THE INVENTION

Rotating devices are used in industry and are seen in playground equipment.

The patents referred to herein are provided herewith in an Information Disclosure Statement in accordance with 37 CFR 1.97.

SUMMARY OF THE INVENTION

The Device (1) provides a rotating shaft (1000) with upper and lower sleeves (1100, 1170) supported by upper and lower bearing assemblies (1130, 1160) within a nipple/coupling frame (1050) which is anchored in a concrete base. The rotating shaft (1000) will support a swing set for children in addition to having other uses.

BRIEF DESCRIPTION OF THE DRAWINGS

The foregoing and other features and advantages of the present invention will become more readily appreciated as the same become better understood by reference to the following detailed description of the preferred embodiment of the invention when taken in conjunction with the accompanying drawings, wherein.

DETAILED DESCRIPTION

Figure 1:
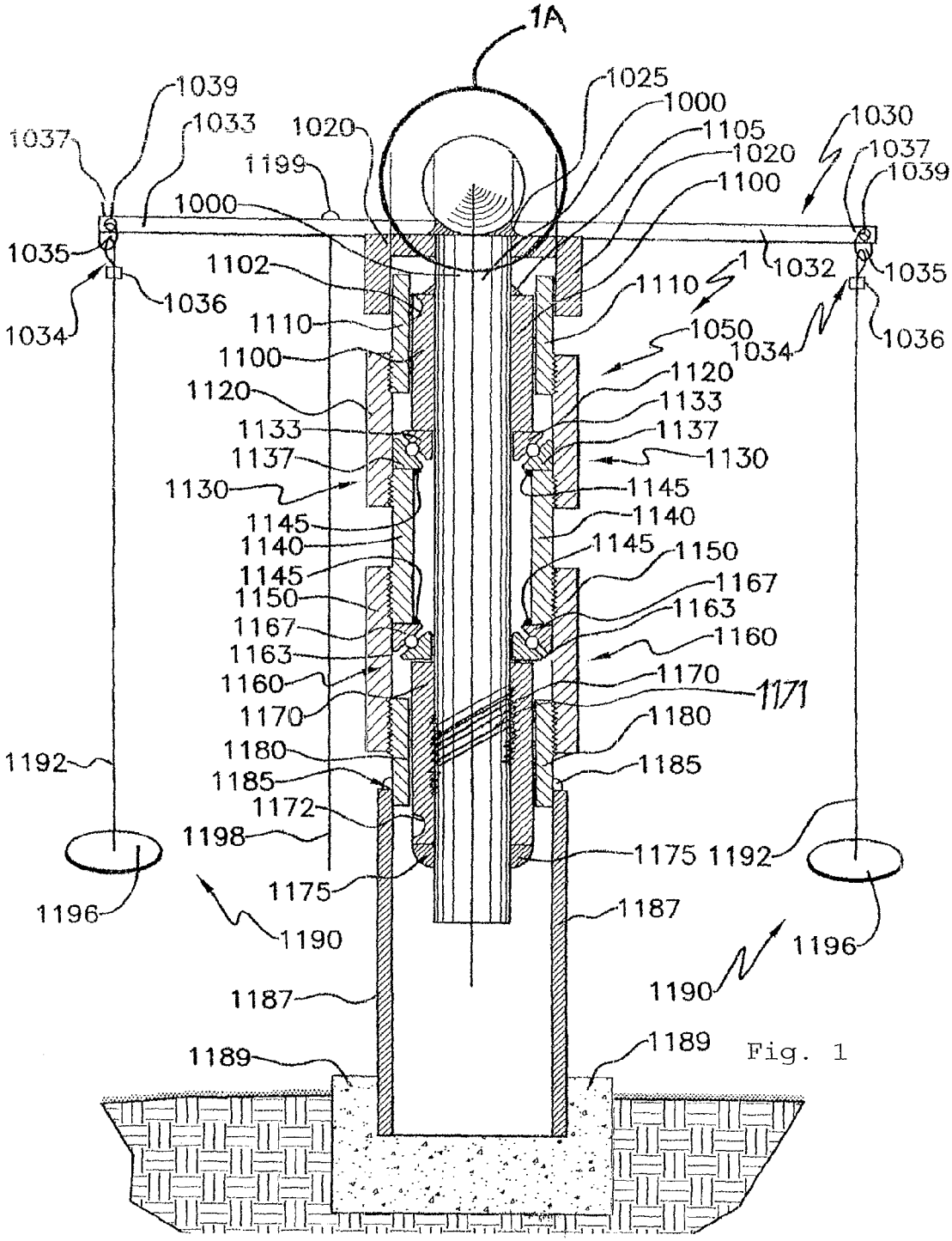
FIG. 1 illustrates a vertical section of the Rotating Device (1) showing the rotating shaft (1000), rotating shaft cover (1020), rotating shaft cover inside diameter (1022), rotating shaft cover weld (1025), swing arm assembly (1030), swing arm right (1032) and swing arm left (1033). Also seen is the nipple/coupling frame (1050), upper sleeve (1100), upper sleeve indentation (1102), upper sleeve weld (1105), sleeve inside diameter (1107), upper nipple (1110), nipple inside diameter (1112), upper coupling (1120) and coupling inside diameter (1122). Also illustrated is the upper bearing assembly (1130), upper bearing (1133), upper bearing race (1137), the intermediate nipple (1140), the lower coupling (1150), lower bearing assembly (1160), lower bearing (1163), lower bearing race (1167), lower sleeve (1170), lower sleeve indentation (1172), lower sleeve weld (1175), lower nipple (1180), swing seat assembly (1190), swing seat suspension (1192), swing seat suspension connector (1194), swing seat (1196), swing cable (1198) and swing cable connector (1199).
Figures 1A, 1B, 1C, 2, 3, 4:
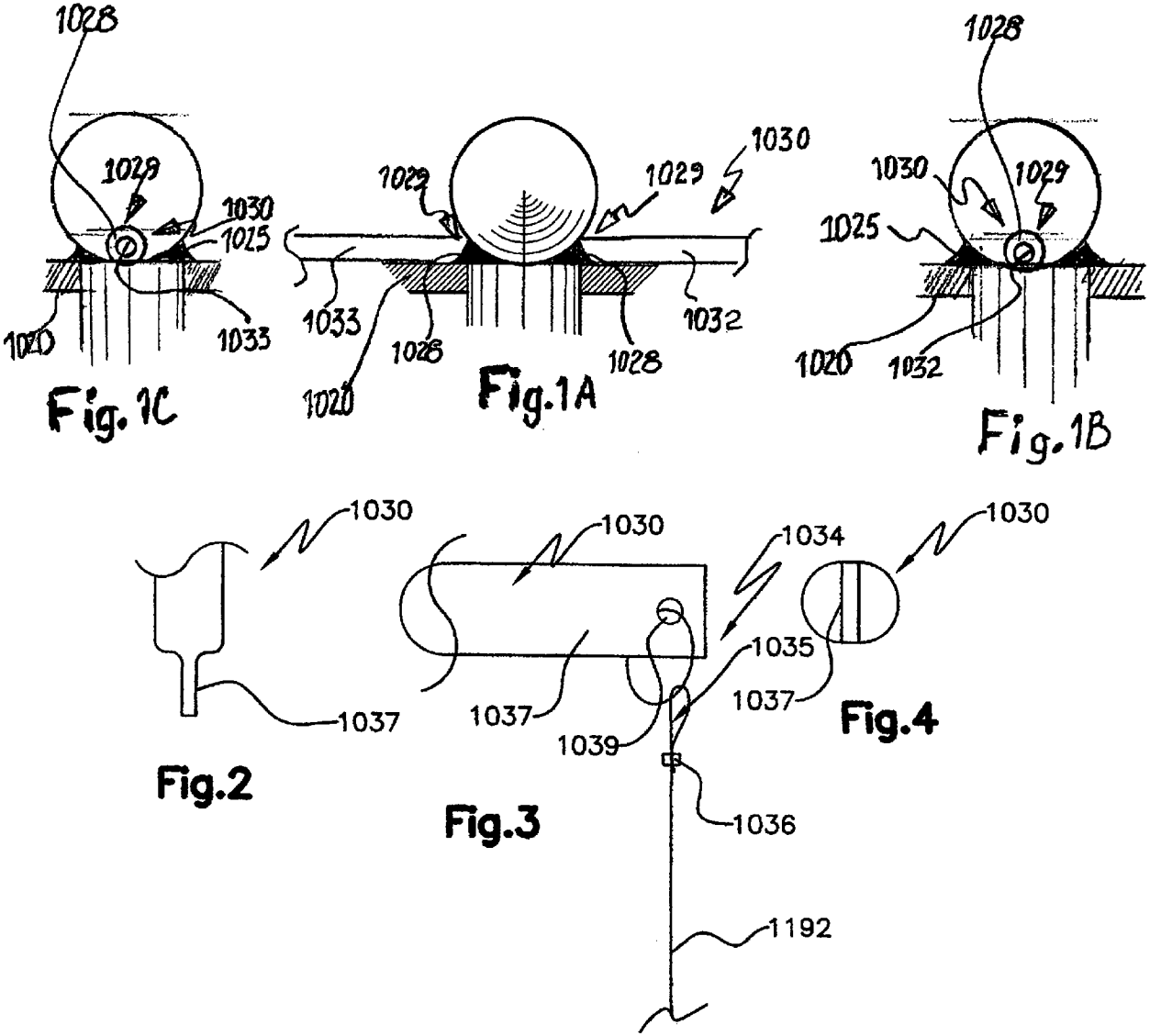
FIGS. 1A, 1B and 1C show swing arm assembly mount assembly (1029), the swing arm assembly mount assembly aperture (1028), swing arm assembly (1030), swing arm right (1032) and swing arm left (1033).
FIGS. 2, 3 and 4 illustrate a detail of the swing arm assembly (1030) showing the swing arm right (1032) and swing arm left (1033) most distal to the rotating shaft (1000); seen is the swing arm swing seat connection system (1034) with a swing arm swing seat connection carabiner (1035), a swing arm swing seat loop ferrule (1036), a flattened swing arm swing seat connection section (1037) and a swing arm swing seat connection aperture (1039).

FIG. 1 illustrates a Rotating Device (1). A cylindrical rotating shaft (1000), in the preferred embodiment, rotates relative to a nipple/coupling frame (1050). It will be appreciated by those of ordinary skill in mechanical arts that a rigid structure, fulfilling the structure formed by the interconnection of nipples and couplings, as is seen hereafter, can be formed and used in place of the combination of nipples and couplings as seen here. Here the preferred embodiment is a nipple/coupling frame (1050) formed of nipples and couplings. An upper sleeve (1100) is slidably received by the rotating shaft (1000) and a lower sleeve (1170) is slidably received by the rotating shaft (1000). The upper sleeve (1100) and the lower sleeve (1170) are rigidly and immovably affixed to the rotating shaft (1000) generally by welding.

An upper bearing assembly (1130) is slidably received by the rotating shaft (1000) and is intermediate the upper sleeve (1100) and the lower sleeve (1170) and is proximal to the upper sleeve (1100) and is distal to the lower sleeve (1170). A lower bearing assembly (1160) is slidably received by the rotating shaft (1000), is intermediate the upper sleeve (1100) and the lower sleeve (1170) and is proximal to the lower sleeve (1170) and is distal to the upper sleeve (1100).

The nipple/coupling frame (1050) rotatably supports the upper bearing assembly (1130) and the lower bearing assembly (1160) allowing the rotating shaft (1000) to rotate relative to the nipple/coupling frame (1050). The nipple/coupling frame (1050) extending downwardly for vertical anchoring of the Rotating Device (1) in a generally concrete foundation.

The cylindrical rotating shaft (1000) is rigid, generally composed of metal pipe. The upper sleeve (1100) and the lower sleeve (1170) are rigid and generally formed of metal pipe.

The upper bearing assembly (1130) is comprised of an upper bearing (1133) and an upper bearing race (1137) and the upper sleeve (1100) bears on the upper bearing (1133). The upper bearing race (1137) is distal to the upper sleeve (1100) and proximal to the lower sleeve (1170).

The lower bearing assembly (1160) is comprised of a lower bearing (1163) and a lower bearing race (1167). The lower sleeve (1170) bears on the lower bearing (1163) and the lower bearing race (1167) is distal to the lower sleeve (1170) and proximal to the upper sleeve (1100).

The nipple/coupling frame (1050) is comprised of an upper nipple (1110) which is sized to be loosely received by the upper sleeve (1100). Extending downwardly the upper nipple (1110) has male threads which mate with female threads of an upper coupling (1120). Extending downwardly the upper coupling (1120) has female threads which mate with male threads of an intermediate nipple (1140). Extending downwardly the intermediate nipple (1140) has male threads which mate with female threads of a lower coupling (1150). Extending downwardly the lower coupling (1150) has female threads which mate with male threads of a lower nipple (1180). The lower nipple (1180) is sized to be loosely received by the lower sleeve (1170).

The upper bearing race (1137) bears on or is supported by the intermediate nipple (1140) proximal to the upper coupling (1120) and is permanently affixed thereto by an intermediate nipple weld (1145). The lower bearing race (1167) bears on or is supported by the intermediate nipple (1140) proximal to the lower coupling (1150) and is permanently affixed thereto by an intermediate nipple weld (1145). The upper bearing race (1137) is contained by the upper coupling (1120) and the lower bearing race (1167) is contained by the lower coupling (1150).

A rotating shaft cover (1020) is upward from the upper nipple (1110) and is immovably affixed by pipe affixing means, generally welding, to the rotating shaft (1000) by a rotating shaft cover weld (1025). In the preferred embodiment, the rotating shaft cover (1020) is outwardly extending from the rotating shaft (1000) and, most distal to the rotating shaft (1000) turns downwardly to receive and contain the upper nipple (1110) distal to the upper coupling (1120). The rotating shaft cover (1020) provides protection for the upper sleeve (1100) and rotating shaft (1000) from the rain and dust.

A swing arm assembly (1030) is comprised of an outwardly extending swing arm right (1032) and an outwardly extending swing arm left (1033). The swing arm right (1032) and swing arm left (1033) are aligned, are generally orthogonal to the rotating shaft (1000) and are formed from rigid materials generally metal pipe. The swing arm assembly (1030) is immovably affixed by pipe affixing means to the rotating shaft (1000) by the rotating shaft cover weld (1025). Pipe affixing means to immovably affix the swing arm assembly (1030) at the rotating shaft cover (1020) includes a variety of pipe affixing means commonly recognized by those of ordinary skill in the pipe affixing arts. Pipe affixing means to immovably affix the swing arm assembly (1030) at the rotating shaft cover (1020) includes welding of the swing arm assembly (1030) to the rotating shaft cover (1020). Alternatively pipe affixing means to immovably affix the swing arm assembly (1030) at the rotating shaft cover (1020) may comprise a swing arm assembly mount assembly (1029) where the swing arm assembly mount assembly (1029) has at least one swing arm assembly mount assembly aperture (1028) sized to receive the swing arm right (1032) and the swing arm left (1033). The swing arm right (1032) and the swing arm left (1033) may comprise a single length of metal pipe which is inserted into the at least one swing arm assembly mount assembly aperture (1028) and is welded thereto. Alternatively, and as the preferred embodiment, the pipe affixing means to immovably affix the swing arm assembly (1030) at the rotating shaft cover (1020) comprising a swing arm assembly mount assembly (1029) where the swing arm assembly mount assembly (1029) has at least one swing arm assembly mount assembly aperture (1028) sized to receive the swing arm right (1032) and the swing arm left (1033) and additionally is threaded. The respective swing arm right (1032) and the swing arm left (1033) are threaded and are threadedly received by the at least one swing arm assembly mount assembly aperture (1028) and are welded to the swing arm assembly mount assembly (1029).

An upper sleeve indentation (1102) is formed in the upper sleeve (1100) to temporarily fix the upper sleeve (1100) in place pending immovably welding the upper sleeve (1100) to the rotating shaft (1000) with the upper sleeve weld (1105). A lower sleeve indentation (1182) is formed in the lower sleeve (1170) to temporarily fix the lower sleeve (1170) in place pending immovably welding the lower sleeve (1170) to the rotating shaft (1000) with the lower sleeve weld (1185). The upper sleeve indentation (1102) and the lower sleeve indentation (1182) are formed by a hammer strike. In the preferred embodiment the rotating shaft (1000) is threaded, with shaft threads (1171) proximal the threaded lower sleeve (1170) to allow tightening of the lower sleeve (1170) against the lower bearing (1163). In an alternative embodiment the rotating shaft (1000) may be threaded with the threads yielding to the deformation of the upper sleeve (1100) and the lower sleeve (1170) when struck by a hammer strike.

At least one swing seat assembly (1190), comprised of a swing seat suspension (1192), which is generally a rope, cable or chain, is connected to the swing arm assembly (1030), distal to the rotating shaft (1000), at the swing arm right (1032) or the swing arm left (1033). The swing seat suspension (1192) is connected by swing seat suspension affixing means comprising generally eye-bolts. At least one swing seat (1196) is affixed by swing seat affixing means to the at least one swing seat suspension (1192) distal to the swing arm right (1032) or the swing arm left (1033). In the preferred embodiment the at least one swing seat (1196) is generally disk shaped and composed of semi rigid materials including plastic. It will be appreciated that the swing seat (1196) can be any platform upon which a child can sit, e.g., a plank, a tube or a bar. The rotating device (1) may be rotated, in the preferred embodiment, by at least one swing cable (1198) connected to the swing arm right (1032) or the swing arm left (1033) by a swing cable connector (1199) comprised of swing cable connector connection means including an eye-bolt or a chain link welded to the swing arm right (1032) or the swing arm left (1033), proximal the rotating shaft (1000). The operator will stand next to the rotating shaft (1000) and pull the at least one swing cable (1198) thereby rotating the rotating device (1).

At least one swing seat suspension (1192) is connected to the swing arm right (1032) and/or the swing arm left (1033) by a swing arm swing seat connection system (1034); the swing seat connection system (1034) is comprised of a swing arm swing seat connection section (1037) of the swing arm right (1032) and separately of the swing arm left (1033) most distal from the rotating shaft (1000); the swing arm swing seat connection section (1037) is flattened with a swing arm swing seat connection aperture (1039) therein; a swing arm swing seat connection carabiner (1035) clip is fastened through the swing arm swing seat connection aperture (1039); a loop is formed in the swing seat suspension (1192) proximal the swing arm right (1032) and also at the swing arm left (1033). The loop is received by the respective swing arm swing seat connection carabiner (1035) clip and is secured by a swing arm swing seat loop ferrule (1036). It will be appreciated that the swing cable (1198) can be comprised of more than one cable, rope or chain. In the preferred embodiment the swing seat (1196) is suspended by a single swing seat suspension (1192).

We claim:

1. A Rotating Device (1) comprising:

a. a cylindrical rotating shaft (1000); an upper sleeve (1100) slidably received by the rotating shaft (1000); a lower sleeve (1170) slidably received by the rotating shaft (1000) distal to the upper sleeve (1100); the upper sleeve (1100) and the lower sleeve (1170) are rigidly and immovably affixed to the rotating shaft (1000) generally by welding;

b. an upper bearing assembly (1130) is slidably received by the rotating shaft (1000), is intermediate the upper sleeve (1100) and the lower sleeve (1170) and is proximal to the upper sleeve (1100) and is distal to the lower sleeve (1170);

c. a lower bearing assembly (1160) is slidably received by the rotating shaft (1000), is intermediate the upper sleeve (1100) and the lower sleeve (1170) and is proximal to the lower sleeve (1170) and is distal to the upper sleeve (1100);

d. a nipple/coupling frame (1050) rotatably supports the upper bearing assembly (1130) and the lower bearing assembly (1160) allowing the rotating shaft (1000) to rotate relative to the nipple/coupling frame (1050); the nipple/coupling frame (1050) extending downwardly for vertical anchoring of the rotating device (1) in a generally concrete support base (1189).

2. The Rotating Device (1) depending from claim 1 and further comprising:

a. the cylindrical rotating shaft (1000), the upper sleeve (1100) and the lower sleeve (1170) are rigid and generally formed of metal pipe;

b. the upper bearing assembly (1130) is comprised of an upper bearing (1133) and an upper bearing race (1137); the upper sleeve (1100) bears on the upper bearing (1133); the upper bearing race (1137) is distal to the upper sleeve (1100) and proximal to the lower sleeve (1170);

c. the lower bearing assembly (1160) is comprised of a lower bearing (1163) and a lower bearing race (1167); the lower sleeve (1170) bears on the lower bearing (1163); the lower bearing race (1167) is distal to the lower sleeve (1170) and proximal to the upper sleeve (1100);

d. the nipple/coupling frame (1050) is comprised of an upper nipple (1110) which is sized to be loosely received by the upper sleeve (1100); extending downwardly the upper nipple (1110), has male threads which mate with female threads of an upper coupling (1120); extending downwardly the upper coupling (1120) has female threads which mate with male threads of an intermediate nipple (1140); extending downwardly the intermediate nipple (1140) has male threads which mate with female threads of a lower coupling (1150); extending downwardly the lower coupling (1150) has female threads which mate with male threads of a lower nipple (1180); the lower nipple (1180) is sized to be loosely received by the lower sleeve (1170); extending downwardly the lower nipple (1180) is received by a downwardly extending support pipe (1187) and the lower nipple (1180) is immovably affixed thereto by a lower nipple weld (1185); the support pipe (1187) is downwardly extending and immovably received or anchored into a support base (1189) comprised generally of concrete;

e. the upper bearing race (1137) bears on or is supported by the intermediate nipple (1140) and is proximal to the upper coupling (1120); the lower bearing race (1167) bears on or is supported by the intermediate nipple (1140) and is proximal to the lower coupling (1150);

f. the upper bearing race (1137) is contained by the upper coupling (1120); the lower bearing race (1167) is contained by the lower coupling (1150).

3. The Rotating Device (1) depending from claim 2 and further comprising:

a. a rotating shaft cover (1020) is upward from the upper nipple (1110) and is immovably affixed by pipe affixing means, generally welding, to the rotating shaft (1000) by a rotating shaft cover weld (1025);

b. a swing arm assembly (1030) is comprised of an outwardly extending swing arm right (1032) and an outwardly extending swing arm left (1033); the swing arm right (1032) and swing arm left (1033) are aligned, are generally orthogonal to the rotating shaft (1000) and are formed from rigid materials generally metal pipe; the swing arm assembly (1030) is immovably affixed by pipe affixing means at the rotating shaft cover (1020) distal to the support base (1189);

c. an upper sleeve indentation (1102) is formed in the upper sleeve (1100) to temporarily fix the upper sleeve (1100), by friction means against the rotating shaft (1000), pending immovably welding the upper sleeve (1100) to the rotating shaft (1000) with the upper sleeve weld (1105); a lower sleeve indentation (1182) formed in the lower sleeve (1170) to temporarily fix the lower sleeve (1170) pending immovably welding the lower sleeve (1170) to the rotating shaft (1000) with the lower sleeve weld (1185);

d. at least one swing seat assembly (1190) comprised of a swing seat suspension (1192), generally a rope, cable or chain, connected to the swing arm assembly (1030), distal to the rotating shaft (1000), at the swing arm right (1032) or the swing arm left (1033); the swing seat suspension (1192) connected by a swing arm swing seat connection system (1034); the swing seat connection system (1034) comprised of swing arm swing seat connection section (1037) most distal from the rotating shaft (1000); the swing arm swing seat connection section (1037) flattened with a swing arm swing seat connection aperture (1039) therein; a swing arm swing seat connection carabiner (1035) hook fastened through the swing arm swing seat connection aperture; a loop formed in the swing seat suspension (1192) proximal the swing arm right (1032) and at the swing arm left (1033); the loop received by the respective swing arm swing seat connection carabiner (1035) and secured by a swing arm swing seat loop ferrule (1036); at least one swing seat (1196) affixed by swing seat affixing means to the at least one swing seat suspension (1192) distal to the swing arm right (1032) or the swing arm left (1033); the at least one swing seat (1196) generally disk shaped and composed of semi rigid materials including plastic;

e. at least one swing cable (1198) connected to the swing arm right (1032) or the swing arm left (1033) by a swing cable connector (1199) comprised of swing cable connector connection means including an eye-bolt or a chain link welded to the swing arm right (1032) or the swing arm left (1033), proximal the rotating shaft (1000);

f. the upper bearing race (1137) is affixed to the intermediate nipple (1140) by an intermediate nipple weld (1145); the lower bearing race (1167) is affixed to the intermediate nipple (1140) by an intermediate nipple weld (1145);

g. the rotating shaft (1000) is threaded, with shaft threads (1171), proximal the threaded lower sleeve (1170) to allow tightening of the lower sleeve (1170) against the lower bearing (1163).

4. The Rotating Device (1) depending from claim 3 and further comprising:

a. the rotating shaft cover (1020) is outwardly extending from the rotating shaft (1000) and, most distal to the rotating shaft (1000) turns downwardly to receive and contain the upper nipple (1110) distal to the upper coupling (1120); the rotating shaft cover (1020) provides protection for the upper sleeve (1100) and rotating shaft (1000) from moisture and dust;

b. the upper sleeve indentation (1102) and the lower sleeve indentation (1182) is formed by a mechanical strike or blow including by a hammer strike;

c. at least one swing cable (1198) connected to the swing arm right (1032) and or the swing arm left (1033) proximal the rotating shaft (1000) by a swing cable connector (1199) comprised of swing cable connector connection means including an eye-bolt.

5. The Rotating Device (1) depending from claim 4 and further comprising:

a. pipe affixing means to immovably affix the swing arm assembly (1030) at the rotating shaft cover (1020) comprising welding of the swing arm assembly to the rotating shaft cover.

6. The Rotating Device (1) depending from claim 4 and further comprising:

a. pipe affixing means to immovably affix the swing arm assembly (1030) at the rotating shaft cover (1020) comprising a swing arm assembly mount assembly (1029); the swing arm assembly mount assembly (1029) having at least one swing arm assembly mount assembly aperture (1028) sized to receive the swing arm right (1032) and the swing arm left (1033); the respective swing arm right (1032) and the swing arm left (1033) welded to the swing arm assembly mount assembly (1029) at the swing arm assembly mount assembly aperture (1028).

7. The Rotating Device (1) depending from claim 4 and further comprising:

a. pipe affixing means to immovably affix the swing arm assembly (1030) at the rotating shaft cover (1020) comprising a swing arm assembly mount assembly (1029); the swing arm assembly mount assembly (1029) having at least one swing arm assembly mount assembly aperture (1028) sized to receive the swing arm right (1032) and the swing arm left (1033); the at least one swing arm assembly mount assembly aperture (1028) is threaded; the respective swing arm right (1032) and the swing arm left (1033) are threaded and are threadedly received by the at least one swing arm assembly mount assembly aperture (1028) and are welded to the swing arm assembly mount assembly (1029).

* * * * *